United States Patent [19]

Shimada et al.

[11] 4,202,538

[45] May 13, 1980

[54] CASTING VESSEL HAVING BASIC LINING AND USAGE THEREOF

[75] Inventors: Noburo Shimada, Tokyo; Akira Miyamoto, Kawasaki; Motonobu Kobayashi, Yokohama; Akio Kuribayashi, Tokyo; Takeharu Toyoda, Yokohama; Morihiro Kimura, Tokyo; Hiroshi Kyoden, Okayama; Toshisuke Hoshino; Jiro Watanabe, both of Bizen, all of Japan

[73] Assignee: Nippon Kokan Kabushiki Kaisha, Tokyo, Japan

[21] Appl. No.: 882,818

[22] Filed: Mar. 2, 1978

[30] Foreign Application Priority Data

Mar. 2, 1977 [JP] Japan ..... 52-21470

[51] Int. Cl.[2] ..... C21B 9/06

[52] U.S. Cl. ..... 266/275

[58] Field of Search ..... 266/275, 276, 280, 281, 266/283–286

[56] References Cited

U.S. PATENT DOCUMENTS

| | | | |
|---|---|---|---|
| 1,378,710 | 5/1921 | Meyerhofer | 266/286 |
| 2,985,442 | 5/1961 | Hilber | 266/285 |
| 3,389,989 | 6/1968 | Finkl | 266/286 |
| 3,528,647 | 9/1970 | Hyde | 266/285 |

OTHER PUBLICATIONS

Foundry; Dec. 1951; pp. 93–94.

*Primary Examiner*—Paul A. Bell

*Attorney, Agent, or Firm*—Armstrong, Nikaido, Marmelstein & Kubovcik

[57] ABSTRACT

The invention concerns a casting vessel having a basic lining, and usage thereof. For putting in practice the casting vessel employing basic refractories as a lining material and in order to avoid such phenomena as exfoliation or others caused by thermal stress generated in the inside of the lining, a backing between the lining and an outer shell is partially or entirely composed of cushion material having thickness within specific range, thereby to absorb said stress and save a life of the lining, and further temperature within the casting vessel is kept above determined temperature before it holds molten metal, thereby to make more efficient use of the life of the basic lining.

7 Claims, 7 Drawing Figures

CASTING VESSEL HAVING BASIC LINING AND USAGE THEREOF

BRIEF DESCRIPTION OF THE INVENTION

This invention relates to a casting vessel, and more particularly to a casting vessel having a basic lining and usage thereof.

The casting ladle is known as the vessel which receives the molten and refined steel, and casts it into the mold. The structure thereof is, in general as seen in FIG. 1, conically composed in cross section of an iron shell (12), a backing (11) and a lining (10).

The lining (10) of the prior art has been composed of the chamotte, agalmatolite or other acid or neutral bricks. However, these materials are disadvantageous because the slag resistability is low and the erosion by the molten metal is high. In view of such circumstances, there have been recently attempts for composing the so-called basic lining casting vessel by using the basic refractories for the lining material which are low in reaction with the slag and excellent in prevention of the erosion of the molten metal loss. But if the basic refractories were used for the lining of the side wall of the casting vessel under the same conditions as in the acid or neutral refractories, the inherent life of the basic refractories could not be saved, because of brittleness and exfoliation of the fairly deep parts from the surface of the lining layer owing to the thermal or structural spallings, and because adherence of the metal or slag is extreme and its removing work is difficult. Thus, it has not been put in practice to use the basic refractories for the lining of the casting vessel. Recently, many studies have been carried out to practise such basic lining, and the inventors of this invention have also offered several proposals and realized successful results in our own ways.

These preceding techniques are roughly divided into an improvement of the structure of the side wall, and a method of controlling the temperatures of the side wall of the vessel. The former is known, for example, as the arrangements of a regenerative layer, an insulating layer and a backing layer on the basic lining layer (Japanese utility publication No. 52-22111). But, since such structures need a relatively thick regenerative layer, the thickness of the lining layer is in general limited and the life of the lining layer is not lengthened. Besides, an extent of expansion of the lining layer is not taken into consideration, the thermal stress is generated in the interior of the lining layer to consequently cause exfoliation.

The latter is known as a method of heating the temperatures of the side wall above 900° C. before the vessel holds the molten steel (Japanese patent application No. 51-12329 laid open to public inspection), or a method of always keeping the temperatures within the ladle above 1100° C. by means of a cover having a heating means (Japanese patent publication No. 50-5657). For satisfying the above conditions, a burner which has a relatively large heating capacity, or a cover of the ladle are required to lower the operating efficiency inconveniently, and according to the studies thereafter it has been found that there still remains a room for further improvements.

The present invention have been developed on the background of these technical accumulation.

A primary object of the invention is to absorb the thermal stress causing exfoliation of the lining, while keeping the merits of the basic lining refractories, thereby to make use of its life for offerring the practical casting vessel.

A second object of the invention is to provide a usage of the basic lining casting vessel which increases the effect of absorbing the thermal stress to more save the life of the casting vessel.

A third object of the invention is to disclose conditions of materials which may display at the maximum the effect of absorbing the thermal stress.

In view that when the basic refractories are used for the lining, the exfoliation is caused owing to the thermal stress which is generated within the basic lining, the invention has brought about structural improvements on the side wall of the casting vessel in order to absorb the thermal stress, that is, in the side wall structure of the casting vessel which is composed of the iron shell, the backing and the basic lining, a cushion material is partially or entirely used for the backing and the thickness of the cushion material is specified between 7 mm and 50 mm.

In such a way, even if the thermal stress is created in the interior of the basic lining of the vessel by repeatedly receiving and casting the steel, the thermal stress is absorbed by compression of the cushion material intervening between the lining and the iron shell, and the exfoliation is avoided. The thickness of the cushion material is specified between 7 mm and 50 mm, so that the characteristics of the cushion material may be functioned under the best condition. In other words, insufficience never happens to the stress absorption, and slack which is apt to occur in the lining and the backing, particularly in a case of using the cushion material, is checked to always maintain close the relation between the lining and the backing, thereby to avoid invasion of the metal into cracks of the lining or difficulties thereby in dissolving the vessel.

Furthermore, the invention keeps the temperatures of the surface of the basic lining at least 500° C. before the vessel receives the molten steel. Difference in time creates abrupt change in temperature in the lining, which inevitably occurs in accordance with the positions in the working yard or the operating conditions in a cycle of the receiving-casting metal, whereby stress is concentrated within the side wall so much that even the cushion material is difficult to absorb it, and it becomes a big cause of exfoliation. However, according to the invention, the inside to contact the molten metal of the vessel is kept above the determined temperature, so that the abrupt change in temperatures may be prevented even if it has a plenty of time before a next charge. Therefore, the stress in the lining may be moderated to an extent that the cushion material absorbs it. The characteristics of the side wall structure can be displayed sufficiently thereby, and its durability may be further increased. Besides, since the heating is determined within the said range and its upper limit is comparatively low, the heating means is simple and the fuel charge is economical.

DETAILED DESCRIPTION OF THE INVENTION

Figure 1:
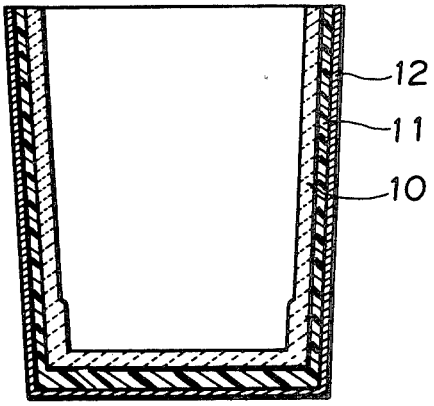
FIG. 1 is a vertical cross section showing one example of the casting vessel of which the invention makes an object.
Figure 2:
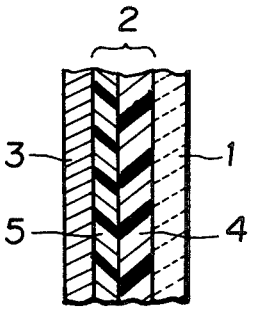
FIG. 2 is a partial cross section showing one example of the casting vessel structure of the invention.
Figure 3:
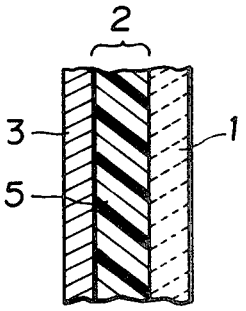
FIG. 3 is a partial cross section showing another example of the casting vessel structure of the invention.
Figure 4:
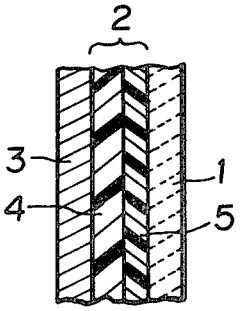
FIG. 4 is a partial cross section showing a further example according to the invention.

The invention will be referred to with reference to the attaching drawings. FIGS. 2 to 4 show embodiments of the casting vessels having the basic lining according to the invention, and in each of them a reference numeral 3 is an iron shell, a numeral 2 is a backing placed on the surface of the iron shell 3, and 1 is a basic lining provided on the surface of the backing 2. In this regard, the invention uses a cushion material 5 such as a ceramic fiber, an insulating board or others partially or entirely for the backing. As far as a layer of the cushion material 5 is used for the backing, a place or conditions are not limited. For example, it is used as a part of the backing 2 as viewed in FIG. 2, namely, the basic lining 1 is provided on its rear with the lining refractories 4 such as the agalmatolite brick or other, and the cushion material 5 is arranged between the lining refractories 4 and the iron shell 3. Further, as seen in FIG. 3, the whole of the backing 2 is the cushion material 5 in place of the lining refractories 4. In addition, the positions of the cushion material 5 and the backing refractories 4 shown in FIG. 2 may be reversed as shown in FIG. 4. In summary, the structure is prepared with an enough countermeasure to the thermal stress. However, it is still insufficient in practising the lining of the basic refractories the only use the cushion material for the part or whole of the backing as mentioned above.

The inventors carried out experiments on a concrete thickness of the cushion material 5 to investigate the most effective range thereof. The experiments used three kinds of the ladles of 60 t, 180 t and 300 t. The side wall was of the structure shown in FIG. 2, and the burned magnesite-dolomite brack (SK>40, MgO: 85%, CaO: 14%) was used for the basic lining 1, and the agalmatolite chamotte brick (SK32) was used for the backing refractories 4, and the ceramic fiber having the thickness of 3 to 60 mm was used for the cushion material 5 and the thickness was variously changed to study the relationship with the life of the lining. Each of the ladles showed as in Table 1.

Table 1

| Capacities / mm | 60t | 180t | 300t |
|---|---|---|---|
| Height | 3000 | 3350 | 3400 |
| Average diameter | 2600 | 3200 | 4000 |
| Thickness of lining | 70 | 200 | 300 |
| Thickness of backing refractories | 40 | 70 | 95 |

Figure 5:
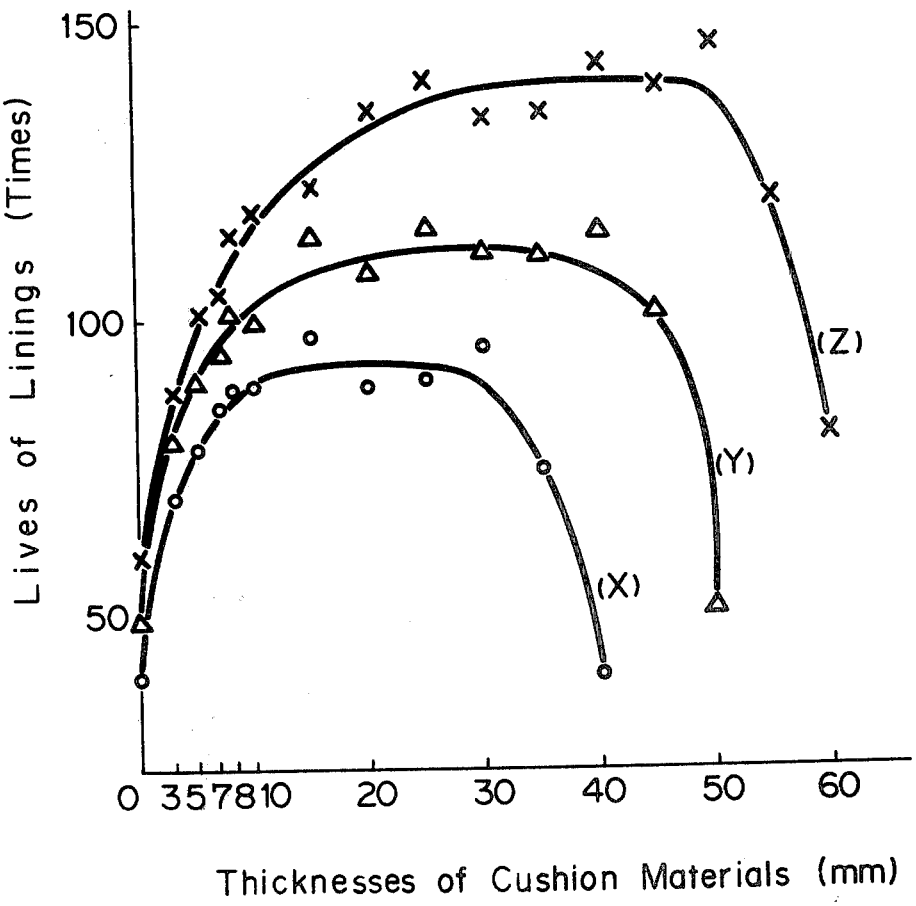
FIG. 5 is a graph showing relationship between thickness of the cushion material and life of the basic lining.

The test results are shown in the graphs of FIG. 5, in which (X) shows changes when the thickness of the lining is 70 mm, (Y) shows changes when the thickness is 200 mm, and (Z) shows changes when the thickness if 300 mm.

As is seen from this table, in each ladle of 60 t, 180 t and 300 t the lives of the linings increase as the thickness becomes thicker, and the usefulness of using the cushion material 5 is acknowledged, but if it is too thick, the life of the lining is decreased. Therefore, the problem is its allowing limit for determining the thickness of the cushion material 5. The thickness of the cushion material is different in dependence on the thickness of the lining 1, but in general if the cushion material 5 is thin, its stress absorbing effect is weak and so the frequency of exfoliation is too much and the merit of the cushion material is little. But if it is too thick, slack occurs in the lining 1 and the backing refractories to considerably shorten the lining life owing to the invasion of the metal into cracks of the lining and to consequently make the dissolution of the vessel difficult. From viewpoint of such circumstances, the invention specifies the thickness of the cushion material 5 not exceeding 50% of the basic lining in the range between 70 mm and 300 mm. If exceeding 50%, the thickness of the basic lining 1 becomes thin relatively and the inherent life of the lining could not be made available. The above refer to the cushion material of the ceramic fiber, and a further investigation was carried out on the various kinds of the insulating borads.

Figure 6:
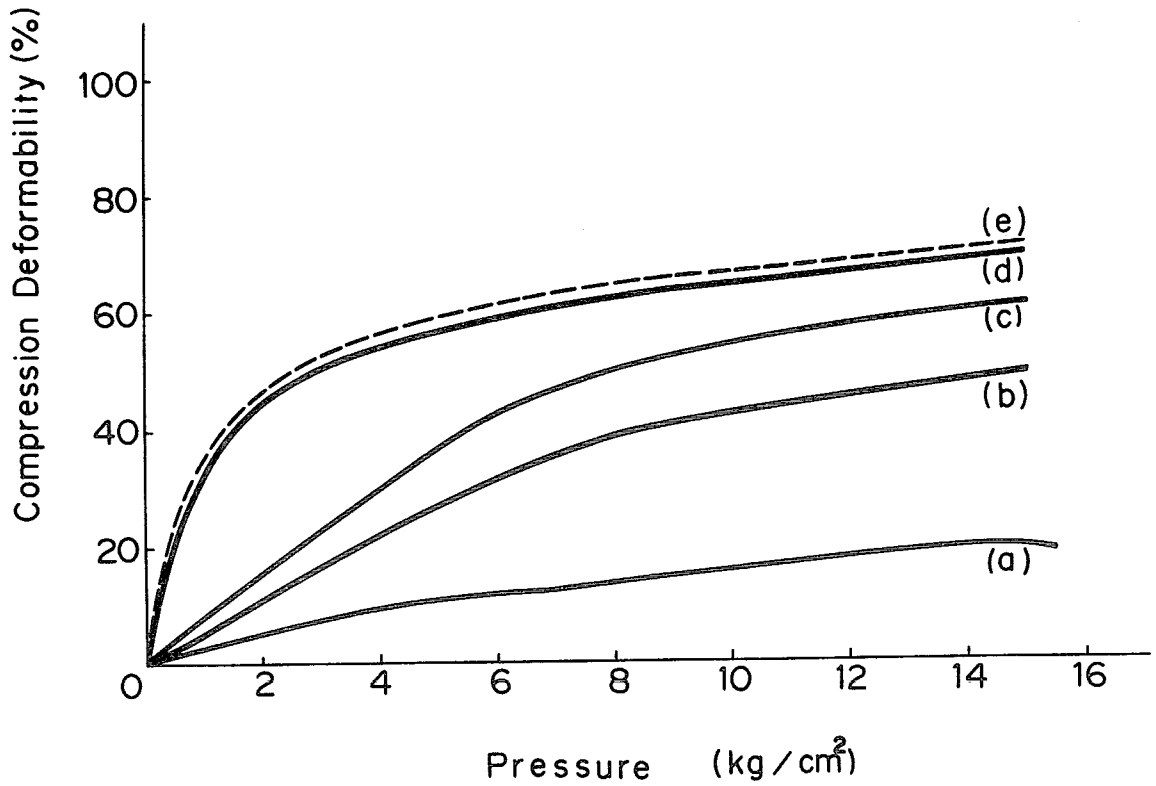
FIG. 6 is a graph showing compression deformabilities of various cushion materials, and, FIG. 7 is a graph showing relationship between distance from the inner side of the lining and temperatures in the interior of the lining of the casting vessel.

FIG. 6 shows curves of compression deformability of various kinds of the cushion materials, in which (a) (b) (c) are of the insulating boards, and (d) (e) are of the ceramic fibers. As shown in the same, the ceramic fibers (d) (e) show the high compression deformabilities in comparison with the insulating boards (a) (b), but such compressive characteristics as these ceramic fibers are not required for the ordinary stress, and according to the experiments each of the insulating boards (a) (b) (c) had the sufficient cushion function, especially the insulating boards (b) (c) showed almost the same results as the ceramic fibers. From such view-points it is found that the material which has the compressive characteristic of more than 10% to the pressure of 10 kg/cm$^2$, can accomplish the said stress absorbing effect for the cushion material 5, but the best is the material which preferably has the compressive characteristic of 40 to 70% to the pressure of 10 kg/cm$^2$. In this point, a material having the compressive characteristic of less than 10% to the pressure of 10 kg/cm$^2$, is very little in the stress absorbing effect, and is not practical because the lining life is short.

The stress generated in the basic lining 1 is absorbed by using the cushion material 5 for the part or whole of the backing 2 to enable to save the lining life. For practising the casting vessel having the above mentioned side wall structure, the inventors further investigated as to the effective usage thereof in order to more increase the stress absorbing effect of the cushion material, and they have come to a conclusion that the temperatures of the part to contact the molten metal within the vessel of the basic lining are kept at least 500° C. before the casting vessel receives the molten metal. This conclusion is based on the following experiments.

Figure 7:
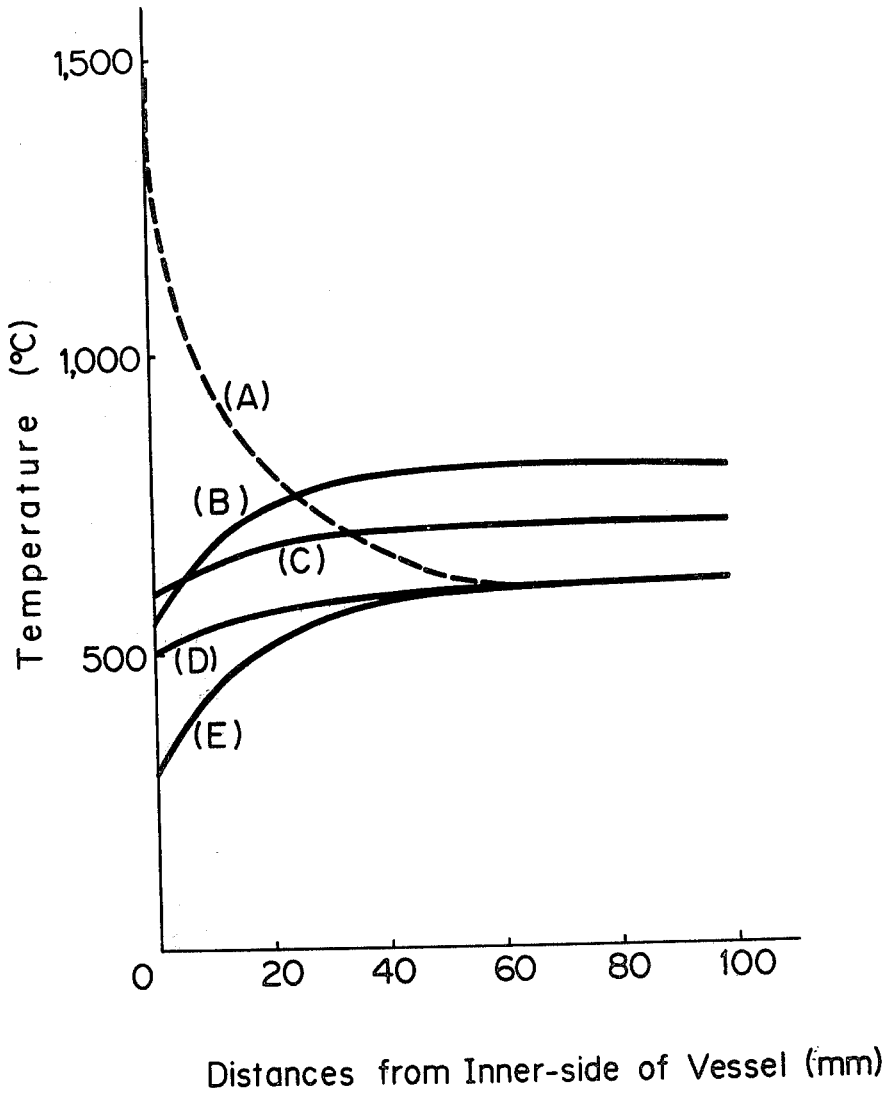

When the operation was carried out with the ladle of 180 t and the cushion material 5 of the ceramic fiber of 20 mm, the lining life was 108 times as shown in FIG. 5. This is a considerable improvement in comparison with the conventional structure of about 60 times without the cushion material. But when surveying the using conditions, there were in total 13 times of still air coolings for more than two hours before the next charge after the casting in the receiving-casting cycle, and during several times thereafter there often occurred the exfoliations. Next, a thermo-couple ($P_tP_tR_h$) was laid in the interior of the basic lining 1 for continuously measuring the temperatures, and at the same time the temperatures within the lining vessel were measured with a radiation pyrometer, when required. The results are shown in graphs of FIG. 7, in which a curve (B) is the temperature of the still air cooling for one hour after casting, a curve (E) is the temperature of the still air cooling for two hours after casting, and a curve (A) is a temperature after five minutes after receiving the steel. As seen in FIG. 7, the curves (A) and (E) show larger differences in temperature as coming near to the inner side of the vessel. These differences are owing to the difference in time which is inevitable in accordance with the places of the working yard, the operating conditions and others. The above mentioned exfoliation is caused by concentration of the stress in the side wall which is so large that the cushion material cannot absorb it, the stress being generated by the abrupt change between the temperatures of the curve (E) or less and that of the curve (A).

For avoiding such abrupt change of the temperature, the inner side to contact the molten steel of the vessel is heated, before receiving the steel, above the determined temperatures by means of the heating means as the burner, but the problem is the limit of the desired temperature. The inventors kept the lowest temperatures within the vessel at 450° C., 500° C. and 600° C. for testing the lining lives at the respective temperatures. The curve (D) of FIG. 6 is a case of heating the inside of the vessel at 500° C. and the curve (C) is a case of heating it at 600° C. The results thereof are in table 2.

Table 2

| Lowest temperatures within the vessel | Lives of the linings |
|---|---|
| 450° C. | 118 times |
| 500° C. | 160 times |
| 600° C. | 162 times |

It is seen from this table that the lining lives are rapidly improved from the lowest temperature of the vessel being 500° C. In other words, when the inside to contact the molten steel of the vessel is heated above 500° C., the difference in temperature between the curves (A) and (E) is reduced, and the stress is made moderate to an extent that it may be absorbed by the cushion material. In these circumstances, the limit of the practically desired temperature is determined more than 500° C. Thus, it is of the importance for effectively using the casting vessel to heat at least 500° C. the inside of the basic lining of the vessel. The upper limit of the heating temperature is not specially limited, but when heating with the lamp oil or heavy oil for about 30 minutes, an upper limit is 1000° C. to 1100° C. However, in general, the heating is not carried out for more than 30 minutes, and practically 700° C. to 900° C. for about 10 minutes.

According to the present invention, as apparently from each of the above said experiments, the part or whole of the backing 2 is substituted with the cushion material 5 of the specified thickness, thereby to absorb the stress generated in the basic lining 1 for making use of the inherent long lives of the basic refractories, and when required the inside of the casting vessel is heated above the determined temperature to more improve the durability. Besides, the temperature limit is low in comparison with that of the prior art, and the fuel charge in economical.

We claim:

1. A casting vessel comprising:

an iron shell forming an exterior of said casting vessel;

a backing positioned on an interior surface of said iron shell, said backing comprised of a cushion material having a thickness of between 7 mm and 50 mm, said cushion material having a compressive characteristic of more than 10% for a pressure of 10 kg/cm$^2$;

a basic lining positioned on said backing, said basic lining having a thickness of between 70 mm and 300 mm, said casting vessel being constructed such that the thickness of said backing is not more than 50% of the thickness of said basic lining.

2. A casting vessel claimed in claim 1, characterized in that the backing is composed of a backing refractories placed on a rear of the basic lining, and a cushion material provided between the backing refractories and the iron shell.

3. A casting vessel claimed in claim 1, characterized in that the backing is composed of a cushion material placed on a rear of the basic lining, and a backing refractories provided between the cushion material and the iron shell.

4. A casting vessel claimed in claim 1, wherein the cushion material is a ceramic fiber.

5. A casting vessel claimed in claim 1, wherein the cushion material is an insulating board.

6. A casting vessel claimed in any of claims 2 to 5 and 1, wherein the cushion material has a compressive characteristic of 40 to 70% to pressure of 10 kg/cm$^2$.

7. A casting vessel claimed in claim 6, the cushion material has thickness not exceeding 50% of the thickness of the basic lining having thickness between 70 mm and 300 mm.

* * * * *